United States Patent [19]

Jordan

[11] 3,955,961

[45] May 11, 1976

[54] CARBOXYLATE METALS PROCESS

[76] Inventor: Robert Kenneth Jordan, The Carlton House, Suite 1431, 550 Grant St., Pittsburgh, Pa. 15219

[22] Filed: Apr. 25, 1974

[21] Appl. No.: 463,981

[52] U.S. Cl. ..... 75/.5 R; 75/.5 B; 75/.5 BA

[51] Int. Cl.[2] ..... B22F 9/00

[58] Field of Search ..... 75/.5 A, .5 AA, .5 R, 75/.5 BA, .5 B

[56] References Cited

UNITED STATES PATENTS

| | | | |
|---|---|---|---|
| 2,497,268 | 2/1950 | Neel | 75/.5 AA |
| 2,636,892 | 4/1953 | Mayer | 75/.5 A |
| 2,827,473 | 3/1958 | Franklin et al. | 75/.5 AA |
| 3,367,767 | 2/1968 | West et al. | 75/.5 AA |

*Primary Examiner*—W. Stallard

[57] ABSTRACT

A process and apparatus for, and certain products of, the production of vanadium, chromium, manganese, iron, cobalt, nickel, copper and zinc by reduction of the corresponding metal carboxylates containing less than 12 percent water by hydrogen or carbon monoxide at 150° to 800°C.

12 Claims, No Drawings

CARBOXYLATE METALS PROCESS

This invention relates to an apparatus and process for, and certain products of, the production of metals of atomic number 23 through 30, and alloys thereof, by hydrogenation of their carboxylates containing a minimal amount of hydrated water.

A myriad of processes are reported in the literature for the production of metals in the form of powders or agglomerations of finely divided particles. A cursory review of the manufacture of iron powder serves to illustrate the state of the art and the problems in achieving a commercially viable process. Most iron powder is now made by atomization of liquid iron or steel, while at one time the grinding of steel and hydrogen reduction of the oxides was practiced extensively. The hydrogen reduction of ferrous chloride was found to be fraught with severe corrosion problems. Iron powder is relatively cheap, a rule of pricing is about twice that of pig iron. Much work is reported on the the decomposition of iron formate and iron oxalate in the literature, but heretofore the cost of these anions has made this approach much too high for use in such a mundane product, at least for most powdered iron uses. But long ago it was discovered that as the particle size of the iron powder was decreased, the particles took on properties of individual magnets in a magnetic field. Magnets produced from very fine particle compacts could be made 10 times more powerful than magnets from an ordinary iron bar of the same weight. Thus, for this and other minor powdered iron uses, decomposition of the formate or oxalate in hydrogen to produce the metal was contemplated, but the advent of ferrite (oxide) magnets of high power relegated the technology to almost industrial extinction.

Ferrous formate and ferrous oxalate decompose thermally in an inert atmosphere to a mixture of the metal and oxide. In general, the lower the temperature of decomposition, the smaller the particle size. The formate begins to decompose in an atmosphere such as nitrogen at about 200°C, but the rate does not become significant until about 275°C. Ferrous oxalate starts to decompose at 300°C and the rate becomes rapid at roughly 400°C. When an atmosphere of hydrogen is used instead of an inert atmosphere, the rates are increased and the product is essentially metal. Copper and nickel formates and oxalates are often reported to decompose to the metal in an inert atmosphere, yet careful analysis of the product always reveals the presence of several percent of the metal oxide. Cobalt formate and oxalate behave much like the corresponding iron compounds yielding a mixture of the oxide and metal in an inert atmosphere and essentially the metal in an atmosphere of hydrogen. The formates and oxalates of vanadium, chromium, manganese and zinc yield only the corresponding oxides when decomposed in an inert atmosphere, and, according to the literature, when decomposed in hydrogen.

Very little literature is found on the decomposition or reduction of other carboxylates such as the carbamates, acetates and malonates. This is particularly surprising in that the carbamates are very easy to produce and the acetates can be relatively cheap to make.

The technical and economic problems associated with the production of metal carboxylates are responsible for the lack of interest in the use of these intermediates for the production of metals. As the carboxylate part of the molecule is destroyed in either the simple decomposition in an inert atmosphere or in a reducing gas like hydrogen, it must be extremely cheap if the metal produced is to be used for alloys as opposed to magnets or catalysts.

The most common process for the production of formates and oxalates begins by the addition of carbon monoxide under pressure to aqueous caustic soda at 60°–80°C which results in the formation of a dilute, perhaps 25 percent, solution of sodium formate. As the solution also contains unreacted caustic soda, the solution must be concentrated so that relatively pure sodium formate can be crystallized from it. But the crystalline product must be dried carefully if it is to be used subsequently for making sodium oxalate. This entails heating the formate to just above the melting point, 253°C, then very rapidly increasing the temperature to 400°–20°C for only a short residence time to cause fusion to the oxalate. Cooling must be conducted rapidly to avoid carbonate buildup. Normally the sodium oxalate is dumped into water and causticized with lime to yield a dilute solution of sodium hydroxide and a precipitate of calcium oxalate. The latter is treated hot with dilute sulfuric acid to precipitate calcium sulfate first, and then on cooling, crystallize out oxalic acid.

If the formate of a metal such as iron or nickel is to be made, the crystalline undried sodium formate can be added to a solution of the metal nitrate, sulfate, chloride or other strong acid salt. As the metal formates are quite soluble in aqueous solution, they must be crystallized out, always as hydrates. Optionally formic acid can be made and reacted with an hydroxide of the metal, if available, but as water is a byproduct, the hydrate is still obtained.

Likewise, the metal oxalates are most easily obtained from aqueous solution. As the metal oxalates are practically insoluble, they are very convenient to make and no doubt this is reflected in the enormous amount of work published on the decomposition of metal oxalates. However, again the precipitates are always obtained as hydrates and like the metal formates are not easy to dehydrate. While British Pat. Nos. 477,230 and 517,455 disclose the conversion of calcium oxalate and a soluble metal salt into complexes of the metal salt which are also solble, the isolated metal oxalate is still hydrated. Moreover, as produced now, both the oxalate and formate anions are very expensive if for no other reasons than the considerable losses of caustic soda recycled and the amount of energy needed to evaporate the sodium formate solution to the point where it can easily be crystallized.

The major factors in the cost of the formate includes the amount of caustic soda consumed, the carbon monoxide used, the metal salt used and the energy required for isolation of the ultimate metal formate. The sodium salt of anion of the metal salt used may sometimes be recovered as a credit, but again with the consumption of considerable energy. Even if the carbon monoxide is very cheap, the end formate cannot be inexpensive.

Likewise the use of metal oxalates entails even more costs in terms of energy because of the need to produce the anhydrous formate along the way. The problems in the utilization of metal acetates are similar in that the sodium salt is usually made which requires caustic soda, and then the metal acetate is made in the same way as the metal formate. While anhydrous metal carbamates are very easily made by the addition of carbon dioxide to a liquid ammonia solution of a salt of the metal, no reduction work is reported in the literature. The malonates are very expensive and have all the problems associated with the formates and oxalates.

While considerable work is published on the thermal decomposition of metal oxalates and formates, there are no clearly defined process for the production of metals by the hydrogenation of metal carboxylates. As noted earlier, the ease of producing these carboxylates has led to numerous investigations, but almost invariably the investigation is one wherein the hydrated metal formate or oxalate is charged to a differential thermal analysis or thermogravametric analysis apparatus and the decomposition observed over a uniform heating pattern to about 600°C. The use of nickel and iron formates in the commercial production of the respective powders for catalysts and magnets is reported, but again the hydrates were used and highly separated very fine powders were the object of these processes. Doremieux et al. used a crust bed in a vertical pyrex reactor heated to 300°–400°C through which hydrogen was passed, Silicates Industriels 37(5),125–35(1972). But again the starting materials were the dihydrates of both nickel and ferrous oxalates. Mayer discloses the preparation of metal oxalates for the production of metal powders in U.S. Pat. No. 2,636,892, but by his process hydrated, not anhydrous, oxalates are produced. Further, his description is typical of one in which the oxalate is decomposed first to an oxide and then the oxide is hydrogenated to the metal.

Therefore, it is an object of my invention to provide an improved process for the production of metals of atomic numbers 23 through 30.

It is another object to provide an improved process for the reduction of metal carboxylates.

It is a further object to provide new compositions of manganese, chromium, vanadium and zinc.

My invention is an apparatus and process for, and certain products of, the production of metals of atomic numbers 23 through 30 wherein a metal carboxylate selected from at least one of oxalates, formates, acetates, carbamates and malonates containing less than 12 percent water is reduced in an atmosphere containing hydrogen or carbon monoxide, or mixtures thereof, at a temperature in the range of from about 150°C to about 800°C.

I have discovered that by the hydrogenation of anhydrous carboxylates of metals of atomic number 23 through 30, ideally at 300°C to 500°C, metals containing practically no oxides can obtained. Furthur, as compared to the same process utilizing the corresponding dihydrate of the metalcarboxylate, a savings of 30 to 40 percent in energy required for the process can be realized. Still further, as a result of a new process for the direct production of anhydrous formates disclosed in my copending application, Ser. No. 433,296 filed Jan. 14, 1974, the metals may be made so economically as to enable their competitive use in alloying and in general use. Moreover, some of the metals provided by the process of my invention herein possess extraordinary physical and chemical characteristics, new in the art.

It is well known that copper and nickel oxalates thermally decompose to what appears to be the pure metal, likewise for the same formates and acetates. But careful analysis shows the presence of several percent metal oxide in each instance. One significant factor in the oxide content of the metal produced has been found to be the water content of the starting material. As the oxalates and formates of these metals are made in aqueous solution, the dihydrates, or even higher hydrates are often obtained. When these are thermally decomposed in an inert atmosphere such as nitrogen or argon, the amount of contained oxide in the product metal is found to be related. Thus the simple dihydrates of nickel and copper decompose in nitrogen to a product which containes from 2 to 5 percent oxide. When the anhydrous formate or carboxylate is thermally decomposed under the same conditions, the oxide content of the products is found to be usually less than 1 percent.

Although very little work is reported for copper carboxylates as compared to nickel carboxylates, the presence of oxide in copper metal is critical to the conductivity of the products. But as nickel has many catalytic uses, especially for hydrogenation, a little oxide hardly affects the performance of the catalyst produced from the nickel containing nickel oxide. For many years nickel formate has been used in the production of these catalysts commercially and it is sold in the form of the normally occurring dihydrate. The dihydrate only begins to give off its water at 140° under normal conditions which is not too far from the 210° at which it begins to decompose to the metal. As the decomposition can be quite exothermic, especially in an atmosphere of hydrogen, the presence of so much water probably acts to exert some control over the decomposition. As noted earlier, Doremieux and his coworkers investigated the thermal decomposition of nickel and ferrous oxalates in hydrogen and selected the dihydrates as starting materials. But the stated purpose of the work was the study of the Kirkendall effect, not the production of metal powders for industrial use.

All the formates and oxalates of the metals of this invention normally precipitate or crystallize from aqueous solution as the the dihydrates. While the effect of contained water cannot be noted on those metal carboxylates that thermally decompose to to only the oxides, it is readily noted with those of iron and cobalt. Again the oxide contents of the mixture obtained from the thermal decomposition of the dihydrates are higher than from the anhydrous carboxylates under the same conditions in an inert atmosphere.

The phenomena is also found for the acetates of nickel, copper, iron and cobalt. Too little work is published on the malonates, but no doubt it extends to these derivatives of the metals too. Again, the carbamates are very easily prepared in the anhydrous state, but in an inert atmosphere they decompose to mainly the oxides, some nitrogen in the form of the cyanate also is found.

The dehydration of the formates, oxalates, malonates and acetates of the metals as obtained from aqueous solutions is not easy. In fact, the copper and nickel carboxylates decompose at only slightly above the temperatures at which the water of hydration is lost. Ideally, the anhydrous carboxylates are obtained by their precipitation from nonaqueous solvents, for example, ammonia. In my copending application, Ser. No. 433,296 filed Jan. 14, 1974 I disclose a new and simple process for the direct production of metal formates in an anhydrous form that is akin to the production of metal carbamates. Likewise the metal acetates can be produced by the same process. While the oxalates and malonates are more difficult to prepare in this way, several have been precipitated directly from liquid ammonia. Again, liquid ammonia is an ideal media for the production of the anhydrous metal carboxylates because any ammoniates decompose readily at comparatively low temperatures.

Less ideal is the dehydration of the hydrated carboxylates at temperatures of approximately 100°C or less, preferrably at reduced pressures. And while it is not a part of this application to produce the carboxylates of lower water content, it is important that the problems associated with water content be shown. When a formate or oxalate of the subject metals is studied and subjected to thermal analysis, i.e. thermogravimetric or differential thermal analysis, invariably a hydrate, usually the dihydrate, is used as the starting material. A sample is heated at a uniform rate, commonly 150°C per hour, and heating proceeds through the dehydration. I have discovered that if the concentration of steam in the atmosphere reaches a threshold level, perhaps lower than 10 percent, the temperature of decomposition of the carboxylate can be lowered by as much as some 100°C. While the presence of steam in the atmosphere only slightly increases the oxide content of copper and nickel, it greatly increases that of the other metals. However, this has been found true of relatively large concentrations of steam, for example 10 percent. The effect of a half percent steam is hardly noticeable. But the water of hydration as found in the usual dihydrates represents a considerable quantity of water, for example the molecular weight of manganous oxalate is 143 and the addition of 2 moles of water means 36 atomic weight units, an increase of 25 percent. The point is that the presence of this water in a sample undergoing thermal analysis can result in data which is misleading. Clearly in a process for the reduction of the carboxylates to metals, the presence of the steam generated through the dehydration can cause catalytic decomposition to the oxide. Further, it is obvious that the presence of the water of hydration necessitates the use of additional heat to vaporize it. Since water has a very high heat of vaporization, it can consume almost as much as required for the decomposition or reduction of the metal carboxylate.

The decomposition of copper and nickel carboxylates to the metal is catalyzed by the use of an atmosphere of hydrogen. Likewise, hydrogen catalyzes the decomposition of nickel carboxylates and acts as both catalyst and reducing agent with the carboxylates of vanadium, chromium, manganese, cobalt, iron and zinc. Other gases have also been found to exert a similar catalytic effect, including helium, neon, methane and ammonia as well as the aforementioned use of steam. Further, only relatively low concentrations of the gases are required to effect the catalysis, the threshold level existing at roughly 10 to 15 percent. Moreover, in the decomposition of nickel and copper carboxylates, these same low concentrations of hydrogen act to greatly reduce the amount of oxide in the product. Even with the other metal carboxylates it is not necessary to have total atmospheres of hydrogen to effect reduction to the metal containing only a trace of oxides. Thus relatively low concentrations of hydrogen in nitrogen, carbon monoxide, carbon dioxide, methane, neon, helium and other gases can be used in the catalytic reduction. Carbon monoxide is also a reducing agent for the metal carboxylates, but it is of special interest to note that it does not have a catalytic effect on the reduction or decomposition process. And while carbon dioxide does not seriously affect the process, its use as a diluent is less ideal. Ammonia acts both as a catalyst and reducing agent but is not nearly as effective a reductant as hydrogen. However, the process can utilize dilute ammonia waste gas streams. Likewise the process can also utilize synthesis gas or producer gas streams, but preferably with most of the contained moisture removed. Again, it should be noted that the literature contains numerous references to the use of very slight amounts of steam in the reducing or decomposition atmosphere to inhibit or reduce the formation of carbon in the product, probably the result of carbon monoxide disproportionation.

It is of special importance that hydrogen contributes to the decomposition or reduction of the metal carboxylates as as catalyst. I have found that the best kinetics for the process are achieved if at least a part of the heat required is supplied through preheating the reducing gas, especially hydrogen. Ideally, at least 50 percent to all of the heat required should be supplied through the atmosphere in which the carboxylates are being reduced, though some preheating of the solids is also desireable. As noted earlier, Doremieux and co-workers employed a crust bed system in a pyrex apparatus. While the heating of the solid bed is not difficult when only a small sample is involved, the uniform heating of a large bed is most difficult. Therefore it is not only a feature of my process to preheat the atmosphere of the process, but also to provide the metal carboxylate in an agglomerated or pelletized form where practical. While sizes up to an average diameter of about 1 centimeter is preferred, larger sizes can be efficiently reduced. In fact it is surprising how rapidly hydrogen can penetrate pelletized spheres of even 2.5 cm diameter. The shape of the pieces is not particularly important though spherical and cylindrical shapes appear not to break up as rapidly as cubes.

The use of the gaseous stream for the supply of the heat to cause the reduction has an advantage not at once apparent, but of considerable importance to the process. In the use of conduction to heat the metal formate, it is easy to get hot spots such that the compound decomposes. If there is an insufficient supply of reducing media at the spot, the oxide will form in all cases excepting with copper and nickel. Thus through addition of the heat required for decomposition, and reduction, by the reducing atmosphere, the probability for obtaining the oxide is greatly minimized. There are two distinct mechanisms possible. First is the interaction of the hydrogen with the metal carboxylate to bring about simultaneous reduction and decomposition. Secondly, the metal carboxylate can be thermally decomposed to a finely divided oxide which then is reduced by the hydrogen or other reductant. By the process of this invention it is essential that the second mechanism be eliminated in so far as possible.

Unexpectedly I have found that by increasing the hydrogen pressure, the process can be accelerated. At roughly 20 atmospheres the kinetics at a given temperature are nearly doubled and by reducing the pressure there is only a slight effect. Thus the process may be conducted over a wide range of temperatures and pressures as the carboxylates decompose with increasing rapidity with increasing temperature. Ideally the process is conducted at between 250° and 500°C for copper and nickel, and, between 350° and 500°C for the other metals. Ideally the pressure should range from roughly 0.8 to 30 atmospheres, though the results obtained at near atmospheric pressure, i.e. one to two atmospheres, are satisfactory.

Zinc is useful in its own right as a material for die-cast parts and as a galvanizing coating for steel. Chromium and vanadium are also widely used as alloying agents. Manganese has been mentioned as a reducing agent for aluminum chloride in the production of aluminum metal. Also it has been considered as a galvanizing coating for steel having characteristics superior to those of zinc coatings.

As the metal carboxylates of differing metals are readily obtained as coprecipitates, the production of alloys with each other and with other metals such as lead, silver, tin and cadmium is quite simple. Thus one can obtain true alloys through the production of solid solutions of the metal carboxylates. Mechanical mixtures can be obtained by mixing the carboxylates or the metal powders. In the production of alloys, it should again be noted that copper and nickel and their carboxylates act as catalysts in the reduction process.

Through the utilization of the various techniques described herein, it is possible to adapt the process of my invention to apparatus heretofore not utilized in the production of metals. Moreover, the various apparatus may be constructed of steel or clad steels instead of ceramic lined equipment. The use of preheated reducing gas is especially adaptable to a horizontal rotary apparatus, akin to a horizontal kiln, in which either the metal carboxylate powders or pellets may be converted to the metals. The use of pellets and preheated reducing gas is ideal for a shaft reducing apparatus like a vertical kiln. The partial heating of the powders or pellets is particularly adaptable to a traveling grate of bed apparatus. In these apparatuses the gas flow is countercurrent to the flow of the solids. Preheated gas and pelletized metal carboxylates are easily adapted to a fluid-bed apparatus wherein the flow of the solids is somewhat tangential to the flow of the gases. Again, while ceramic lined equipment may be utilized for the conduct of the process, it is a novel feature that the process may be conducted in steel equipment.

Heretofore it has not been possible to produce metals economically through the decomposition or reduction of their carboxylates simply because the cost of the carboxylate anion was too expensive. Nickel catalysts and iron magnets are exceptions which are priced far above ordinary iron and nickel powders. Through the utilization of my copending application, Ser. No. 433,296 filed Jan. 14, 1974 and entitled CARBOXYLATE METALLATION PROCESS, anhydrous formates may be produced directly from formic acid or ammonium formate. In turn the formic acid may be prepared by the carbonylation of methanol with subsequent hydrolysis, or the the hydration of formamide which in turn is made by the carbonylation of ammonia. In the process of making the anhydrous metal formate, valuable coproducts such as ammonium nitrate, are obtained. For example, the addition of manganous nitrate to a liquid ammonia solution of ammonium formate yields a precipitate of manganous formate and a liquid ammonia solution of ammonium nitrate.

Another application of the CARBOXYLATE METALLATION PROCESS lies in the economic production of the oxalate anion. When ammonium formate is added to a liquid ammonia solution of sodium chloride, anhydrous sodium formate precipitates almost immediately. Simple fusion of the anhydrous sodium formate at about 400°C yields sodium oxalate, which when causticized with lime yields an aqueous solution of sodium hydroxide and a precipitate of calcium oxalate. Calcium oxalate is easily converted into other metal oxalates, such as the metal oxalates useful in the present process. In essence, the cost of the formate anion is that of carbon monoxide in terms of raw materials and the energy consumption is negligible. The raw material cost of the oxalate an is even less because of the coproduct credit and likewise the energy consumption is negligible.

While the metal carbamates are readily produced from carbon dioxide bubbled through a liquid ammonia solution of a soluble metal salt, the decomposition of amidates thermally in an inert atmosphere result in the conversion of much of the contained amino group to nitrogen. This is of course uneconomical, but I have discovered that in the hydrogenation process of the present invention, the loss of ammonia is minimized, though still not negligible. Until recently acetates have been expensive because the acetic acid needed was produced by the oxidation of ethylene. Now a process for acetic acid based on carbon monoxide and methanol has been developed which makes the use of acetates more economical. Unfortunately there is still no cheap process for the production of malonates developed. Cheap carbon monoxide suitable for the production of formic acid, ammonium formate and acetic acid is already available in the form of blast furnace top gas.

According to the provision of the patent statutes, I have explained the principle of my invention and have illustrated what I now consider to represent its best embodiment. However, I desire to have it understood that within the scope of the appended claims, the invention may be practiced otherwise than as specifically illustrated and described.

I claim:

1. A process for the production of metals of atomic numbers 23 through 30 wherein a metal carboxylate selected from at least one of oxalates, formates, acetates, carbamates and malonates containing less than 12 percent water is reduced in an atmosphere containing hydrogen or carbon monoxide, or mixtures thereof, at a temperature in the range of from about 150°C to about 800°C.

2. The process of claim 1 in which a solid metal carboxylate containing less than 5 percent water having a size in the range of from about 300 mesh to about 3 cm is reduced by a reducing gas heated at a temperature in the range of from about 150°C to about 700°C.

3. The process of claim 1 wherein the reducing gas contains from about 10 to about 50 percent of at least one of helium, ammonia, steam and methane.

4. The process of claim 2 where the metal carboxylate is a formate, oxalate or carbamate of manganese.

5. The process according to claim 2 conducted in an apparatus of horizontal, vertical, fluid-bed and traveling grate or bed kilns.

6. The process of claim 5 in which an apparatus is selected consisting of steel kiln construction for service at a temperature in the range of from about 200°C to about 700°C in an atmosphere containing hydrogen or carbon monoxide at a pressure in the range of from about 0.8 to about 30 atmospheres.

7. The process of claim 6 in which the apparatus is selected from externally insulated and clad on the inside with a metal or ceramic cladding.

8. The process of claim 7 in an apparatus having an inner surface selected from nickel, titanium, tantalum, steel, porcelain and glass.

9. The process of claim 6 which apparatus comprises a horizontal kiln of steel.

10. The process of claim 6 which apparatus comprises a vertical kiln of steel.

11. The process of claim 6 which apparatus comprises a fluid-bed kiln of steel.

12. The process of claim 6 which apparatus comprises a traveling grate or traveling bed kiln of steel.

* * * * *